US006302394B1

(12) United States Patent
Chou

(10) Patent No.: US 6,302,394 B1
(45) Date of Patent: Oct. 16, 2001

(54) GAME TABLE

(76) Inventor: Aileen Chou, 6F-3, No. 21, Lane 12, Chia-Pei St., Chia-Yi City (TW)

( * ) Notice: Subject to any disclaimer, the term of this patent is extended or adjusted under 35 U.S.C. 154(b) by 0 days.

(21) Appl. No.: 09/578,159

(22) Filed: May 23, 2000

(51) Int. Cl.[7] ..... A63F 7/06; A63F 7/20

(52) U.S. Cl. ..... 273/108.1; 273/108.51; 273/129 R; 273/108.56

(58) Field of Search ..... 273/108, 108.1, 273/108.2, 108.21, 108.22, 108.3, 108.31, 108.32, 108.33, 108.4–108.57, 129 R–129 W, 317–317.9; 446/381, 365, 330, 376, 379

(56) References Cited

U.S. PATENT DOCUMENTS 1,324,783 * 12/1919 Bain .
1,926,980 * 9/1933 Gormans .
2,722,211 * 11/1955 Eisele .
2,827,035 * 3/1958 Modica .
3,112,930 * 12/1963 Wertz .
3,862,513 * 1/1975 Isaacson .
4,033,584 * 7/1977 Smith .
4,042,239 * 8/1977 Cecchetti .
4,146,224 * 3/1979 Deutsch .
4,304,405 * 12/1981 Laine .
4,976,434 * 12/1990 Wikner .
5,810,362 * 9/1998 Jensen .

* cited by examiner

*Primary Examiner*—Sebastiano Passaniti
(74) *Attorney, Agent, or Firm*—Townsend and Townsend and Crew LLP

(57) ABSTRACT

A game table includes an elongate horizontal base wall, and two short side walls and two long side walls to confine a simulated soccer field space. At least two manipulating rods are mounted rotatably and transverse to the long side walls in a first axis. Each rod has two end portions protruding to be outboard to the long side walls so as to form two handle grips thereon, and at least one torso portion secured thereon so as to rotate therewith. A lower limb portion is disposed between each torso portion and the base wall, and includes upper and lower ends, and an intermediate section pivoted to the respective torso portion such that when the upper end is pulled, the lower end will swing about a second axis transverse to the first axis. A cord member has a connecting end secured to the upper end, and a pulled end led towards the handle grip such that a jerking of the pulled end towards the handle grip will actuate the swinging of the lower end. An actuating member is disposed on each manipulating rod and proximate to the handle grip to actuate the jerking of the pulled end.

8 Claims, 6 Drawing Sheets

GAME TABLE

BACKGROUND OF THE INVENTION

1. Field of the Invention

This invention relates to a game table, more particularly to a game table for simulating a soccer field space in which a plurality of rotary manipulating rods are mounted to swing a plurality of toy models mounted thereon.

2. Description of the Related Art

Referring to FIG. 1, a conventional game table 1 is shown to include a table top 1 with a simulated soccer field space 10 confined by a rectangular surrounding wall 11, a plurality of manipulating rods 12 disposed rotatably on the surrounding wall 11, and a plurality of toy models 13 secured on the manipulating rods 12 so as to rotate therewith. The user can move and rotate the manipulating rods 12 to swing the corresponding toy models 13 such that an enlarged section 132 of a lower limb portion 131 can swing to kick a ball member (not shown) in the simulated field space 10. However, the conventional game table is monotonous in his operation, and is dull to play with.

SUMMARY OF THE INVENTION

The object of the present invention is to provide a game table in which the toy models thereof have swingable lower limb portions and even upper limb portions to enhance its appeal when playing therewith.

According to this invention, the game table includes an elongate horizontal base wall, and two short side walls and two long side walls which extend uprightly from a periphery of the base wall, and which are disposed opposite to each other in a longitudinal direction and a first transverse direction, respectively so as to cooperate with the base wall to confine a simulated soccer field space. At least two manipulating rods are disposed respectively between and transverse to the long side walls, and are spaced apart from each other in the longitudinal direction. Each manipulating rod extends in the first transverse direction, and has two end portions which are mounted rotatably and respectively to the long side walls and which protrude to be outboard to the long side walls respectively so as to form two handle grips thereon to rotate about a first axis parallel to the first transverse direction, and an intermediate portion which is interposed between the end portions and located in the simulated soccer field space. At least two torso portions are secured respectively on the intermediate portions of the manipulating rods so as to rotate therewith. A lower limb portion is disposed between each torso portion and the base wall in a second direction transverse to both the longitudinal and first transverse directions, and includes upper and lower ends, and an intermediate section which connects the upper end to the lower end and which is pivoted to the respective torso portion about a second axis that is parallel to the longitudinal direction and proximate to the upper end. When the upper end is pulled in the first transverse direction, the lower end will swing about the second axis. A cord member has a connecting end which is secured to the upper end of a respective lower limb portion, and a pulled end which is led towards a respective handle grip. Thus, a jerking of the pulled end towards the handle grip will actuate the swinging of the lower end of the respective lower limb portion. An actuating member is disposed on each manipulating rod and proximate to a respective handle grip to actuate the jerking of the pulled end of a respective cord member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
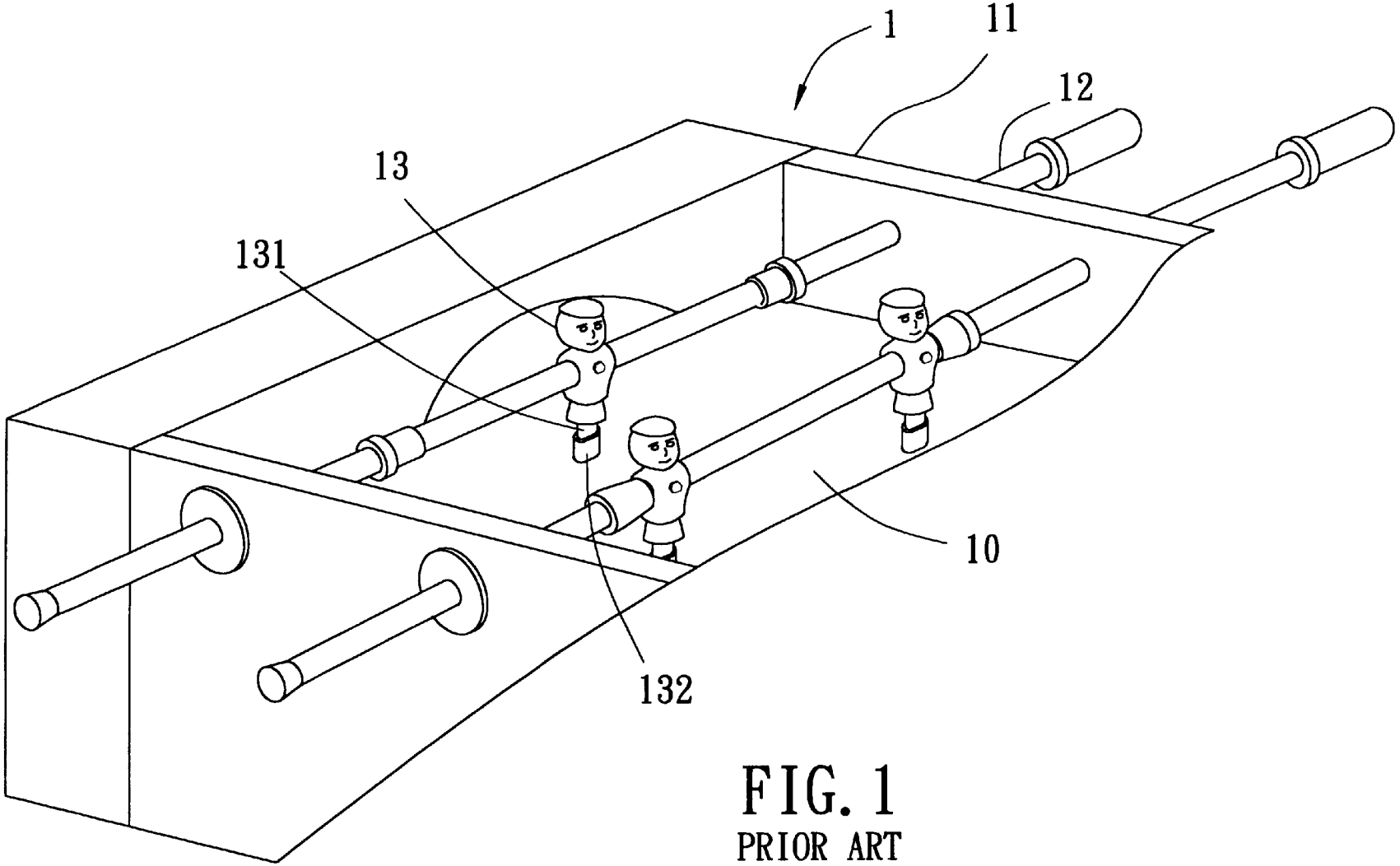
FIG. 1 PRIOR ART
FIG. 1 is a perspective view of a portion of a conventional game table.
Figure 2:
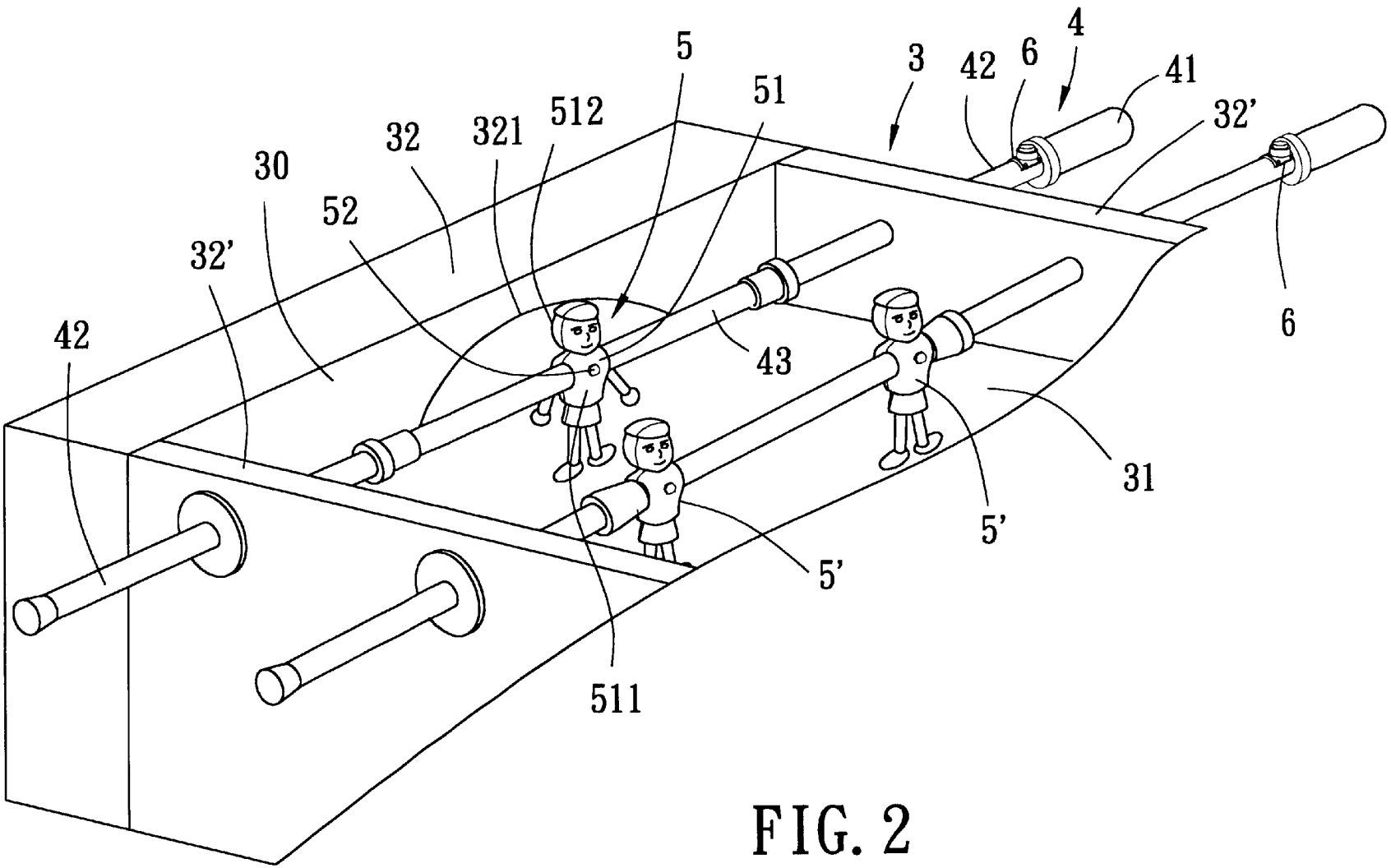
FIG. 2 is a perspective view of a portion of a preferred embodiment of a game table according to this invention.

Referring to FIG. 2, the preferred embodiment of the game table according to the present invention is shown to comprise a table top 3, a plurality of manipulating rods 4, two goal keeper models 5, and a plurality of player models 5'.

The table top 3 includes an elongate horizontal base wall 31, two short side walls 32 (only one is shown) and two long side walls 32' which extend uprightly from a periphery of the base wall 31, and which are disposed opposite to each other in a longitudinal direction and a first transverse direction, respectively so as to cooperate with the base wall 31 to confine a simulated soccer field space 30. Two recesses 321 are provided in the short side walls 32 to form two simulated goal areas.

Figure 3:
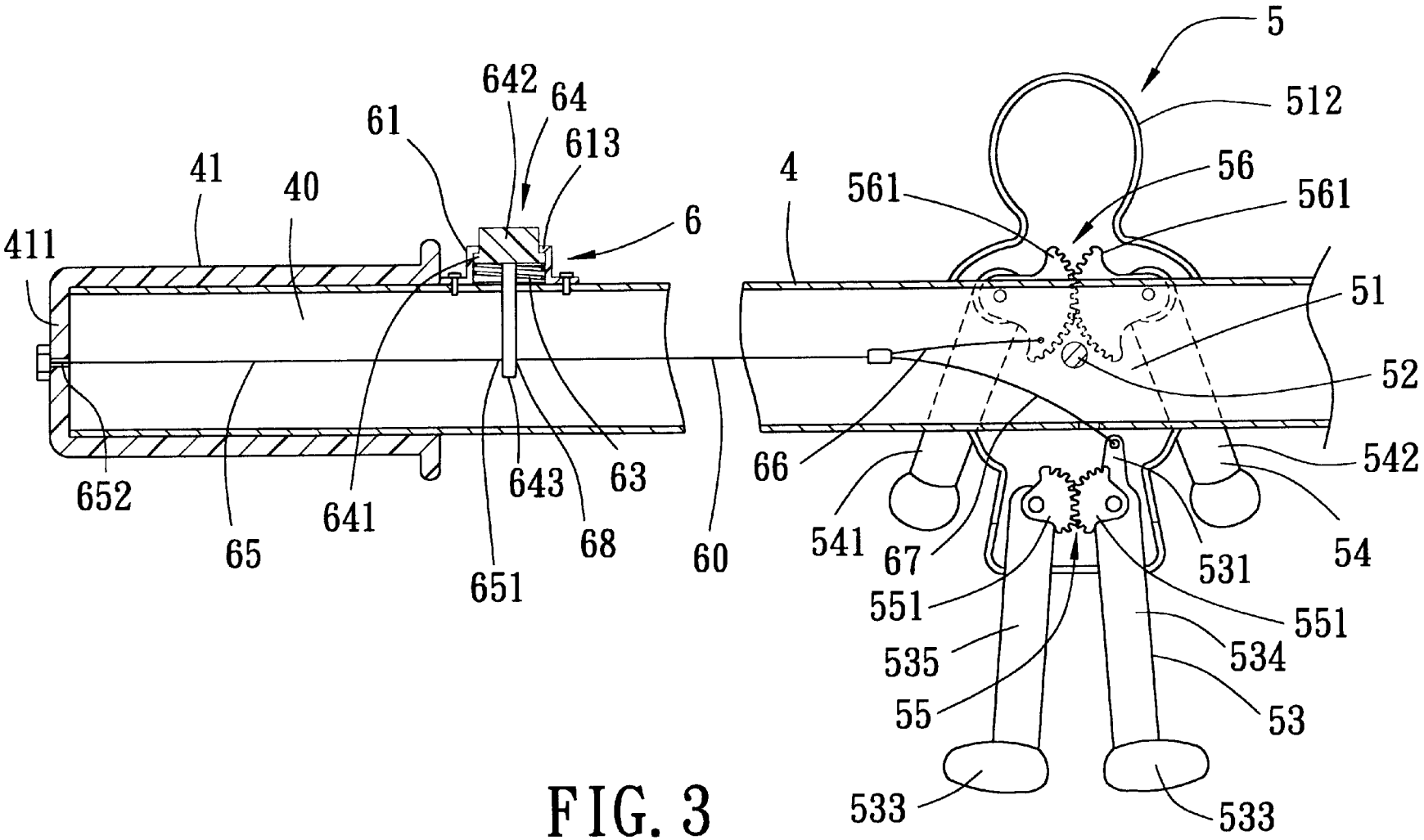
FIG. 3 is a sectional view of a portion of the preferred embodiment.

The manipulating rods 4 are disposed respectively between and transverse to the long side walls 32' and are spaced apart from each other in the longitudinal direction. Each manipulating rod 4 extends in the first transverse direction, and has two end portions 42 which are mounted rotatably and respectively to the long side walls 32' and which protrude to be outboard to the long side walls 32' respectively so as to form two handle grips 41 thereon to rotate about a first axis parallel to the first transverse direction, and an intermediate portion 43 which is interposed between the end portions 42 and which is located in the simulated soccer field space 30. As shown in FIG. 3, the manipulating rod 4 has a passageway 40 therein which extends axially and through the intermediate portion 43. The handle grip 41 has an end wall 411 transverse to the intermediate portion 43. The goal keeper models 5 are disposed on the rightmost and leftmost manipulating rods 4, respectively. The player models 5' are disposed on the remaining manipulating rods 4.

Figure 4:
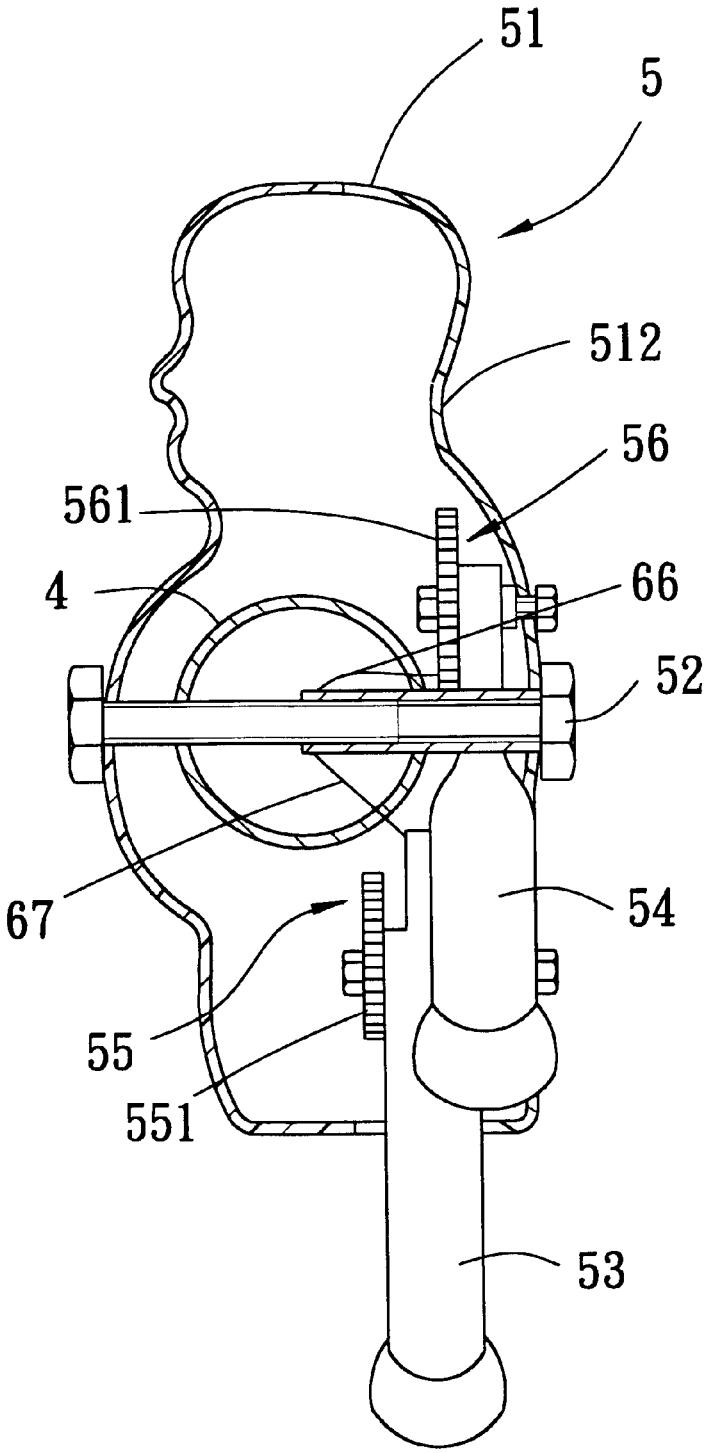
FIG. 4 is a sectional view of a goal keeper model of the preferred embodiment.

With reference to FIGS. 3 and 4, each model 5 includes a torso portion 51 which has front and rear housing halves 511,512 engaging each other and which is secured on the intermediate portion 43 of the respective manipulating rod 4 by a screw fastener 52 so as to rotate therewith, and a lower limb portion 53 which is disposed between the base wall 31 and the torso portion 51 in a second direction transverse to both the longitudinal and first transverse directions. The lower limb portion 53 includes a first upper end 531, two first lower ends 533, and a first intermediate section which connects the first upper end 531 to one of the first lower ends 533 and which is pivoted to the torso portion 51 about a second axis that is parallel to the longitudinal direction and proximate to the first upper end 531. In particular, the intermediate section includes first right and left portions 534,535 which are spaced apart from each other in the first transverse direction and which are respectively pivoted about two pivot axes parallel to the second axis to the torso portion 51. The first right portion 534 is connected to the first upper end 531. A first coupling member 55 includes a pair of first gear segments 551 which mesh with each other. Thus, when the first upper end 531 is pulled in the first transverse direction, the first lower ends 533 will swing about the pivot axes due to transmission of the pulling force applied on the first upper end 531 to the first left portion 535.

A cord member 60 is received in the passageway 40, and has a connecting end 67 which is secured to the first upper end 531 of the respective lower limb portion 53, and a pulled end 68 which is led towards the respective handle grip 41 such that a jerking of the pulled end 68 towards the respective handle grip 41 will actuate the swinging of the first lower ends 533 of the respective lower limb portion 53.

In addition, each goal keeper model 5 further includes an upper limb portion 54 which is disposed on the torso portion 51 above the lower limb portion 53. The upper limb portion 54 includes second left and right portions 541,542, and a second coupling member 56. The second left portion 541 has a forced end which is connected to the connecting end 67 by another cord member 66, a turned end, and a pivoted portion which is interposed between the forced and turned ends and which is pivoted to the torso portion 51 about a third axis that is parallel to the longitudinal direction and proximate to the forced end such that when the forced end is pulled by the cord member 60 in the first transverse direction, the turned end will swing about the third axis. The second right portion 542 is spaced apart from the second left portion 541 in the first transverse direction and is pivoted about a fourth axis parallel to the third axis to the torso portion 51. The second coupling member 56 includes a pair of second gear segments 561 which mesh with each other and which are disposed respectively on the second left and right portions 541,542 to turn respectively about the third and fourth axes when the pulling force applied on the forced end is transmitted to the second right portion 542. An actuating member 6 is disposed on the respective manipulating rod 4 and proximate to the respective handle grip 41 to actuate the jerking of the pulled end 68 of the respective cord member 60.

Referring again in FIG. 3, in this embodiment, an anchoring cord member 65 has a joining end 651 which is integrally formed with the pulled end 68, and an anchoring end 652 which is secured to the end wall 411 of the handle grip 41 so as to tense the respective cord member 60 in the first transverse direction. Each actuating member 6 includes a button 64 and a biasing spring 63. The button 64 includes a head 642 which is disposed on and movable radially relative to a seating 61 on the respective manipulating rod 4, and a stem 643 which has a proximate end that is connected to the head 642 and a distal end that extends radially and inwardly of the manipulating rod 4 and into the passageway 40 so as to depress the joining end 651 to jerk the pulled end 68 of the respective cord member 60 when the head 642 moves radially and towards the passageway 40. A biasing spring 63 is disposed between the head 642 and the seating 61 to bias the head 642 radially and away from the passageway 40. By virtue of engagement between projecting portions 641 of the head 642 and a flange portion 613 of the seating 61, the head 642 can be prevented from undesired removal from the seating 61.

Each player model 5' is similar to the goal keeper model 5 in constructions, except that no upper limb portion is provided on the former.

Figure 5:
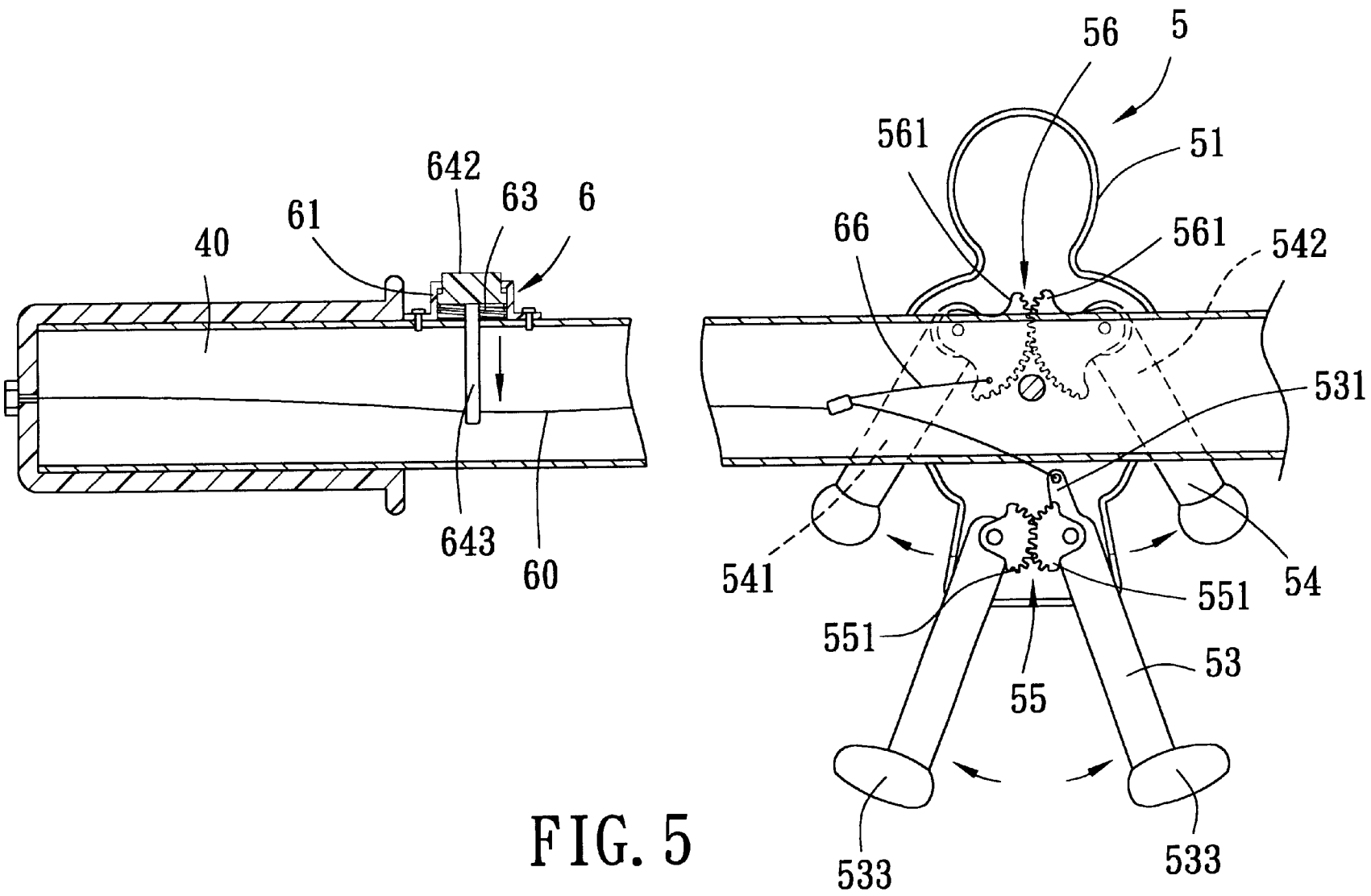
FIG. 5 is a sectional view similar to FIG. 3 but in an operating state.

Therefore, as shown in FIG. 5, when the head 642 is depressed to jerk the cord member 60 so as to actuate the swinging of the first lower ends 531 of the lower limb portion 53, the first lower ends 533 will swing about the pivot axes by the action of the first coupling member 55. At the same time, the jerking force of the forced end of the second left portion 541 to swing the turned end will be transmitted to swing the second right portion 542 by the action of the second coupling member 56. As such, the game table has a variety of actions to enhance user appeal when playing therewith.

Figure 6:
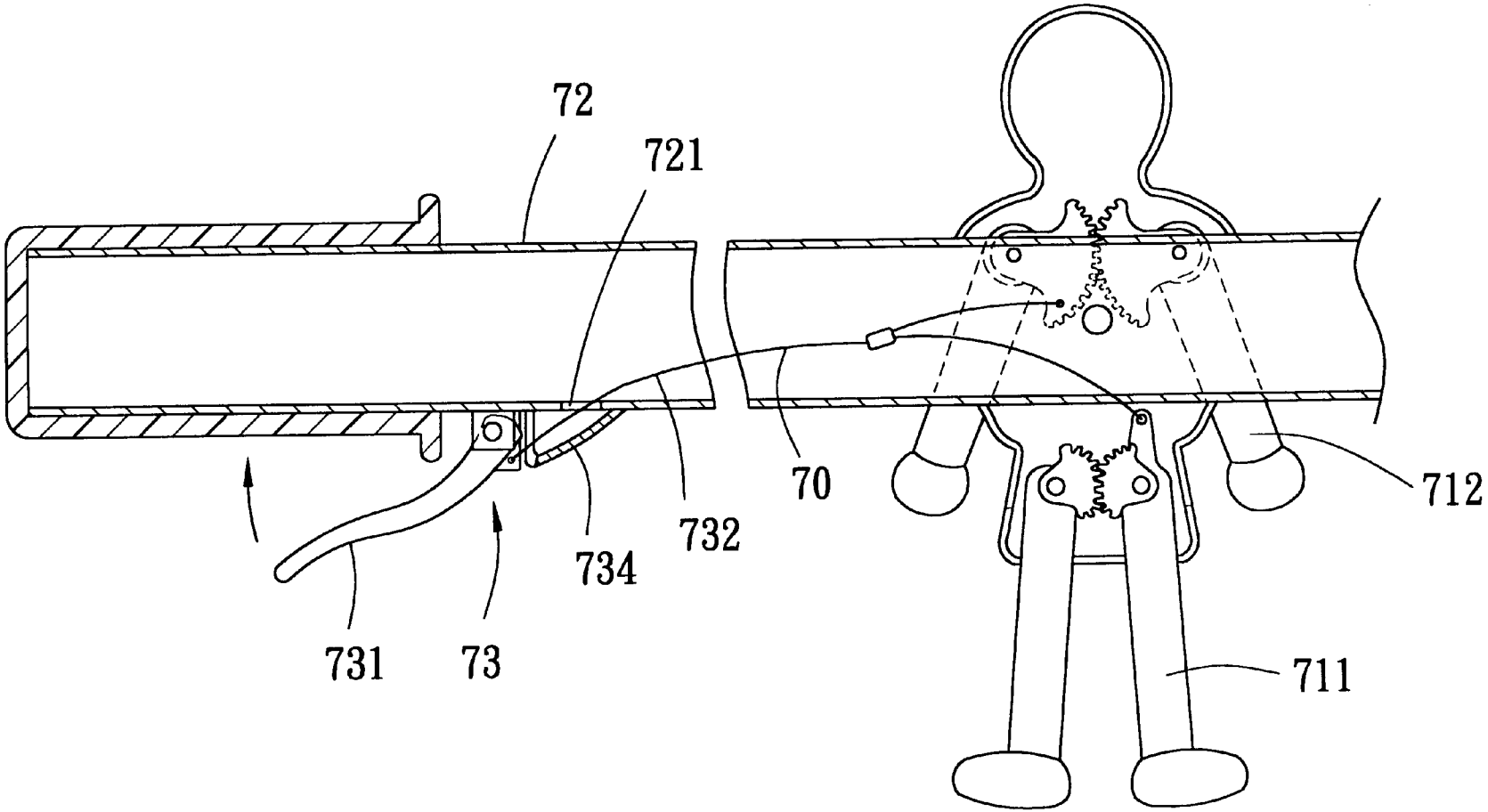
FIG. 6 is a sectional view of a portion of another preferred embodiment of the game table according to this invention.

Referring to FIG. 6, another preferred embodiment of the game table according to this invention is shown to be similar to the above embodiment in construction, except that each of the actuating members 73 includes a handlebar 731 which is pivoted to the respective manipulating rod 72 about a fifth axis. The pulled end 732 of the respective cord member 70 passes through a hole 721 formed in the manipulating rod 72, and engages the handlebar 731 such that a rotation of the handlebar 731 about the fifth axis toward the manipulating rod 72 will actuate the jerking of the pulled end 732 to swing the upper and lower limb portions 712,711. A cover member 734 is disposed on the manipulating rod 72 adjacent to the handlebar 731 to cover the pulled end 732 of the cord member 70.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A game table comprising:

an elongate horizontal base wall;

two short side walls and two long side walls extending uprightly from a periphery of said base wall, and disposed opposite to each other in a longitudinal direction and a first transverse direction, respectively so as to cooperate with said base wall to confine a simulated soccer field space;

at least two manipulating rods disposed respectively between and transverse to said long side walls and spaced apart from each other in the longitudinal direction, each of said manipulating rods extending in the first transverse direction, and having two end portions which are mounted rotatably and respectively to said long side walls and which protrude to be outboard to said long side walls respectively so as to form two handle grips thereon to rotate about a first axis parallel to the first transverse direction, and an intermediate portion interposed between said end portions and located in said simulated soccer field space;

at least two torso portions secured respectively on said intermediate portions of said manipulating rods so as to rotate therewith;

at least two lower limb portions, each disposed between said base wall and a respective one of said torso portions in a second direction transverse to both the longitudinal and first transverse directions, and including first upper and lower ends, and a first intermediate section connecting said first upper end to said first lower end and pivoted to said respective one of said torso portions about a second axis that is parallel to the longitudinal direction and proximate to said first upper end such that when said first upper end is pulled in the first transverse direction, said first lower end will swing about the second axis;

at least two cord members, each having a connecting end secured to said first upper end of a respective one of said lower limb portions, and a pulled end which is led towards a respective one of said handle grips and which is disposed to be such that a jerking of said pulled end towards said respective one of said handle grips will actuate the swinging of said first lower end of the respective one of said lower limb portions; and at least two actuating members, each disposed on a respective one of said manipulating rods and proximate to a respective one of said handle grips to actuate the jerking of said pulled end of a respective one of said cord members.

2. The game table as claimed in claim 1, wherein said first intermediate section includes first right and left portions spaced apart from each other in the first transverse direction and respectively pivoted about two pivot axes parallel to the second axis to said respective one of said torso portions, said first right portion being connected to said first upper end, said first intermediate section further including a first coupling member disposed to transmit the pulling force applied on said first upper end to said first left portion.

3. The game table as claimed in claim 2, wherein said first coupling member includes a pair of first gear segments meshed with each other and disposed to turn respectively about the pivot axes when the pulling force is transmitted.

4. The game table as claimed in claim 3, wherein said manipulating rods are disposed respectively proximate to said short side walls, and further comprising at least two upper limb portions disposed respectively on said torso portions above said lower limb portions, each of said upper limb portions including a second left portion which has a forced end secured to said connecting end of a respective one of said cord members, a turned end, and a pivoted portion which is interposed between said forced and turned ends and which is pivoted to said respective one of said torso portions about a third axis that is parallel to the longitudinal direction and proximate to said forced end such that when said forced end is pulled by said respective one of said cord members in the first transverse direction, said turned end will swing about the third axis.

5. The game table as claimed in claim 4, wherein each of said upper limb portions further includes a second right portion spaced apart from said second left portion in the first transverse direction and pivoted about a fourth axis parallel to the third axis to said respective one of said torso portions, and a second coupling member disposed to transmit the pulling force applied on said forced end of said second left portion to said second right portion.

6. The game table as claimed in claim 5, wherein said second coupling member includes a pair of second gear segments meshed with each other and disposed to turn respectively about the third and fourth axes when the pulling force is transmitted.

7. The game table as claimed in claim 1, wherein each of said manipulating rods has a passageway therein extending axially and through said intermediate portion for passage of said pulled end of said respective one of said cord members, and an end wall transverse to said intermediate portion and distal to said connecting end, said game table further comprising an anchoring cord member having a joining end disposed in said passageway to be integrally formed with said pulled end and an anchoring end secured to said end wall so as to tense said respective one of said cord members in the first transverse direction, each of said actuating members including a head which is disposed on and movable radially relative to said respective one of said manipulating rods, a stem which has a proximate end connected to said head and a distal end extending radially and inwardly of said respective one of said manipulating rods and into said passageway so as to depress said joining end to jerk said pulled end of said respective one of said cord members when said head moves radially and towards said passageway, and a biasing spring disposed to bias said head radially and away from said passageway.

8. The game table as claimed in claim 1, wherein each of said actuating members includes a handlebar pivoted to said respective one of said manipulating rods about a fifth axis and engaging said pulled end of said respective one of said cord members such that a rotation of said handlebar about the fifth axis toward said respective one of said manipulating rods will actuate the jerking of said pulled end of said respective one of said cord members.

* * * * *